United States Patent [19]

Towley, III et al.

[11] Patent Number: 5,011,141

[45] Date of Patent: Apr. 30, 1991

[54] BENCH PRESS WITH ADJUSTABLE SAFETY/RANGE LIMITING BARS

[75] Inventors: Carl K. Towley, III; Dennis C. Johnson, both of Owatonna, Minn.

[73] Assignee: Lumex, Inc., Bay Shore, N.Y.

[21] Appl. No.: 486,119

[22] Filed: Feb. 28, 1990

[51] Int. Cl.[5] ..... A63B 21/078

[52] U.S. Cl. ..... 272/123; 272/144

[58] Field of Search ..... 272/70, 70.2, 93, 117, 272/123, 134, 144; 248/244

[56] References Cited

U.S. PATENT DOCUMENTS

| | | | |
|---|---|---|---|
| D. 258,975 | 4/1981 | Irvine . | |
| 982,279 | 1/1911 | Knape | 248/244 |
| 2,703,692 | 3/1955 | Felix | 248/244 |
| 2,902,242 | 9/1959 | Bergström | 248/244 |
| 4,231,570 | 11/1980 | Reis | 272/123 |
| 4,262,901 | 4/1981 | Faust | 272/117 |
| 4,368,884 | 1/1983 | Colvin | 272/123 |
| 4,471,956 | 9/1984 | Marlo | 272/123 |
| 4,474,370 | 10/1984 | Oman | 272/144 |
| 4,509,746 | 4/1985 | Mask | 272/144 X |
| 4,529,194 | 7/1985 | Haaheim | 272/70 X |
| 4,564,194 | 1/1986 | Dawson | 272/123 |
| 4,602,785 | 7/1986 | Rockwell | 272/123 |
| 4,700,944 | 10/1987 | Sterba et al. | 272/117 |
| 4,773,642 | 9/1988 | Croz | 272/123 |
| 4,789,152 | 12/1988 | Guerra | 272/144 |
| 4,799,672 | 1/1989 | Barrett | 272/123 |
| 4,799,673 | 1/1989 | Selle | 272/123 |
| 4,807,875 | 2/1989 | Tanski | 272/123 |
| 4,861,024 | 8/1989 | Lee | 272/123 |
| 4,955,604 | 9/1990 | Pogoe | 272/123 |
| 4,958,833 | 9/1990 | Stater | 272/123 |
| 4,973,050 | 11/1990 | Santoro et al. | 272/117 |

FOREIGN PATENT DOCUMENTS

| | | | |
|---|---|---|---|
| 85489 | 5/1958 | Denmark | 248/244 |
| 834517 | 11/1938 | France | 248/244 |
| 1449289 | 10/1965 | France | 248/244 |
| 279164 | 3/1952 | Switzerland | 248/244 |

OTHER PUBLICATIONS

Advertisement for "Pro Max Bench", In Coach & Athlete, Mar. 1981, p. 62.

*Primary Examiner*—Robert Bahr

*Attorney, Agent, or Firm*—John W. Bunch

[57] ABSTRACT

Bench press (10) includes adjustable safety/range limiting bars (50) mounted for incremental adjustment over a wide range beneath the weight bar support pins (40, 42) in the uprights (14). The bench (24) is preferably positioned at a predetermined reduced height so that the knees of the athlete are substantially above the plane defined by his/her head, shoulders and back or hips to achieve more stability and to avoid arching and thus straining the lower back.

11 Claims, 2 Drawing Sheets

BENCH PRESS WITH ADJUSTABLE SAFETY/RANGE LIMITING BARS

TECHNICAL FIELD

The present invention relates generally to exercise and physical rehabilitation equipment. More particularly, this invention concerns an improved bench press for weight training which incorporates incrementally adjustable safety/range limiting bars and other advanced features for better overall performance, increased durability and reduced maintenance costs.

BACKGROUND ART

Bench presses for weight training have been available for years. Such bench presses typically include an elevated bench extending between a pair of supports on which a weight bar is placed. Lying on his/her back on the bench, the athlete first grips the weight bar and then pushes it upward and slightly forward off of the supports before lowering the weight bar toward his/her chest and then pushing it upward again until completing the desired number of repetitions, after which the weight bar is returned to its supports. Bench pressing is typically strenuous and involves a substantial amount of weight, such that it is desirable to have someone stand by to act as a "spotter" to assist if necessary in stabilizing the weight bar or returning it to its supports. However, a suitable spotter may not be available, which in turn can lead to an unsafe condition if the athlete tires, cannot replace the weight bar and becomes pinned beneath it.

A variety of bench press safety mechanisms have been available heretofore. U.S. Pat. Nos. 4,799,673; 4,799,672; 4,602,785; 4,368,884 and 4,231,570 are representative of the prior art in this regard. However the bench press safety mechanisms of the prior art have tended to be either overly complicated, altogether unadjustable, or if so, only adjustable over a limited range.

There has thus been a long-felt need for an improved bench press which incorporates adjustable safety/range limiting bars as well as other advanced design features for improving overall safety and enhancing effective training.

The present invention comprises an improved bench press which overcomes the foregoing and other difficulties associated with the prior art. In accordance with the invention, there is provided a bench press including a pair of laterally spaced apart uprights, which are preferably angled rewardly at an acute angle off vertical. The uprights are interconnected by a frame, which supports a flat bench midway therebetween. Pegs are provided in spaced relationship with the top ends of the uprights for supporting a weight bar. Adjustable safety/range limiting bars are provided in the uprights beneath the support pegs. Vertical positioning of the safety/range limiting bars can be incrementally adjusted as desired. Wear plates are preferably provided on the uprights for reduced noise and maintenance costs. The top surface of the bench is preferably set at a predetermined height off the floor so that the plane defined by the head, shoulders and back or hips of the athlete substantially beneath his knees while his/her feet are on the ground, for better safety and stability.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
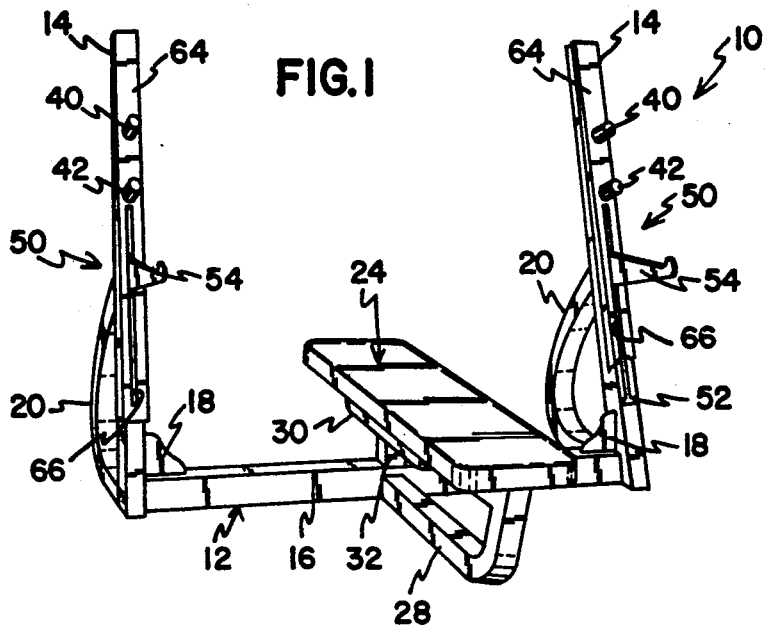
FIG. 1 is a perspective view of the bench press incorporating the invention.

Referring now to the Drawings, wherein like reference numerals designate like or corresponding elements throughout the views, and particularly referring to FIG. 1, there is shown the bench press 10 incorporating the invention. As will be explained more fully hereinafter, the bench press 10 incorporates several advanced design features for better safety, performance and durability.

Figure 2:
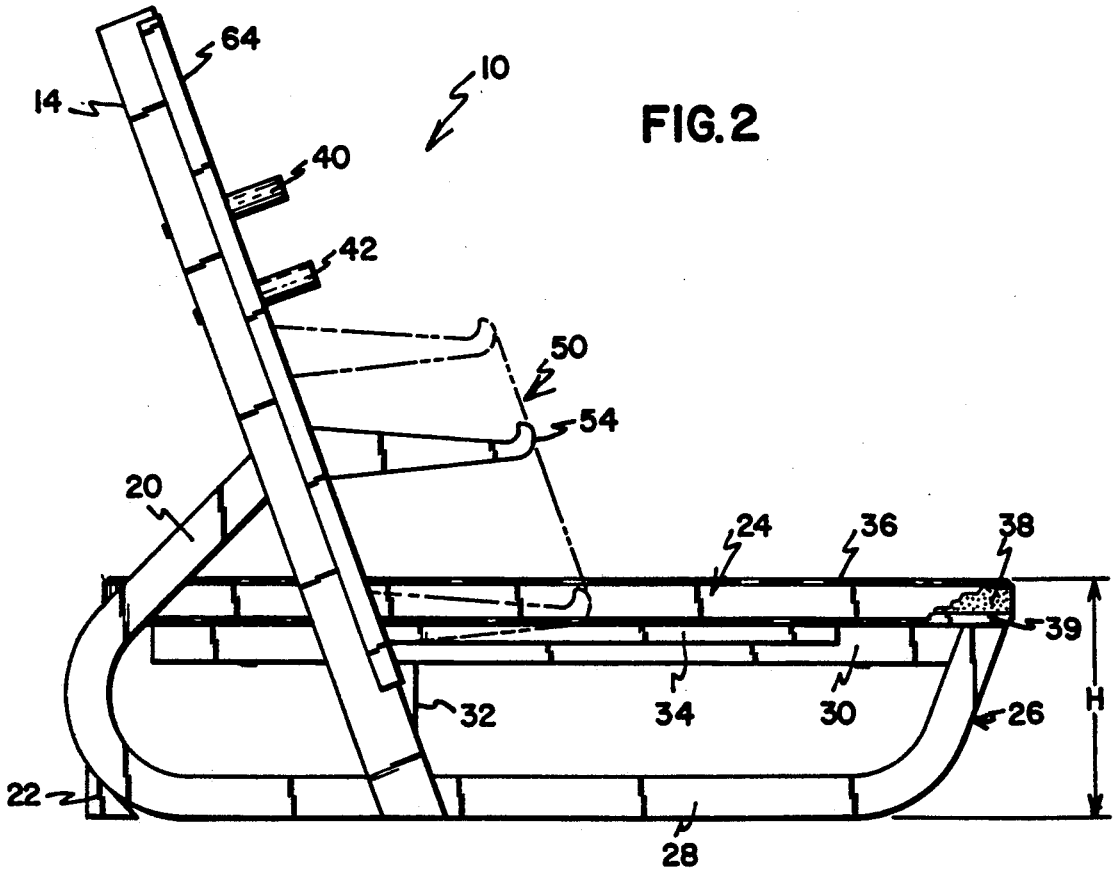
FIG. 2 is a side view of the bench press herein.

Referring to FIGS. 1 and 2, the bench press 10 includes a main frame 12 comprising a pair of laterally spaced apart uprights 14 interconnected at their lower ends by a cross member 16. In the preferred embodiment, the uprights 14 and cross member 16 are formed from steel tubing of square or rectangular configuration. Gussets 18 are preferably secured between the top surface of the cross member 16 and the inside surfaces of the uprights 14 for reinforcement.

As is best seen in FIG. 2, the uprights 14 are preferably inclined rewardly at an acute angle off vertical. For example, the uprights 14 can be inclined at an angle between about 18 and 25 degrees, preferably about 20 degrees. A rear brace or leg 20 is secured to each upright 14. As shown, the braces or legs 20 are of generally C-shaped configuration, and are also preferably formed from metal tubing of square or rectangular cross section. Wedge-shaped blocks 22 are provided on the braces or legs 20 for stabilization and rear tip-over prevention.

An elevated bench 24 is supported midway between the uprights 14 on a subframe 26 secured to the mainframe 12. The subframe 26 comprises a longitudinal J-shaped support member 28 secured at one end to the cross member 16. The other end of the J-shaped support member 28 is secured to a longitudinal top member 30 which is supported near its other end by a post 32 extending upwardly from the top surface of the cross member 16. The bench 24 is mounted on the top member 30 with the head of the bench positioned between uprights 14, and the foot of the bench extending outwardly therefrom. A pair of horizontally disposed lateral C-shaped braces 34, only one of which is shown, are preferably secured to the sides of the top member 30 underneath the bench 24 for additional lateral reinforcement. The bench 24 preferably comprises an upholstered cover 36 enclosing a pad 38 and a rigid underlying base 39 of wood or other suitable material.

In accordance with the preferred construction, the top surface of the bench 24 is positioned a predetermined distance H above the floor or underlying support surface, as shown in FIG. 2, so that the plane defined by the head, shoulders and back or hips of the athlete lying on the bench (which plane is parallel to the flat horizontal top surface of the bench) is substantially beneath the knees of the athlete. The height H can range between about 10 and 14 inches, and preferably about 12 inches.

This comprises an important feature of the present invention. The standard bench height according to the International Power Lifting Federation specifications is 17 inches, but is not derived from a logical anthropomorphic average. An athlete lying on his back tends to push with his feet against the floor as he/she is pushing the weight bar upward, thus arching his/her back into an exagerated position causing compression on the rear side and expansion on the front side of the discs in the lumbar area in the case of the "standard" bench height. Undue pressure is thus exerted on the spinal discs and adjoining vertebrae which can potentially lead to a herniated disc condition. The five points of contact when doing bench presses are the head (1), shoulders (2), back or hips or buttocks (3), and feet (4 and 5). Maintaining these five points of contact is important in order to afford the athlete maximum stability, which is the key to generating maximum strength when bench pressing. It has been found that a reduced bench height H of between of about 10 and 14 inches, and preferably about 12 inches, will result in the knees of the athlete being elevated substantially above the plane defined by his/her head, shoulders, back and hips for about 95% of the male and female athletes between 4'10" and 6'6" tall, according to data in *Human Scale,* Volumes I–VI, by Henry Dreyfus Associates. Thus, the athlete's back is pressed against the bench, rather than arched, which in turn eliminates the expansion/compression forces and greatly reduces lower back strain. A bench height H in this preferred range also has the advantage of eliminating the need for a spotter's stand because the training partner or spotter is already located in a power position during lift off and spot.

At least one support peg or take-off pin 40 is provided near the top end of the front surface of each upright 14 for supporting a weight bar (not shown) therebetween. In the preferred embodiment, a second support peg or take-off pin 42 is provided in spaced relationship beneath the top pin 40 to accommodate athletes of different heights and arm lengths. Each adjacent pair of support pegs or take-off pins 40 and 42 are spaced apart a sufficient distance, such as about 6 inches, to avoid interference with the top pins when the lower-most pins are being used. The pins 40 and 42 are secured in fixed positions along the uprights 14 in a preferred embodiment, although they may be adjustably secured if desired.

Figure 3:
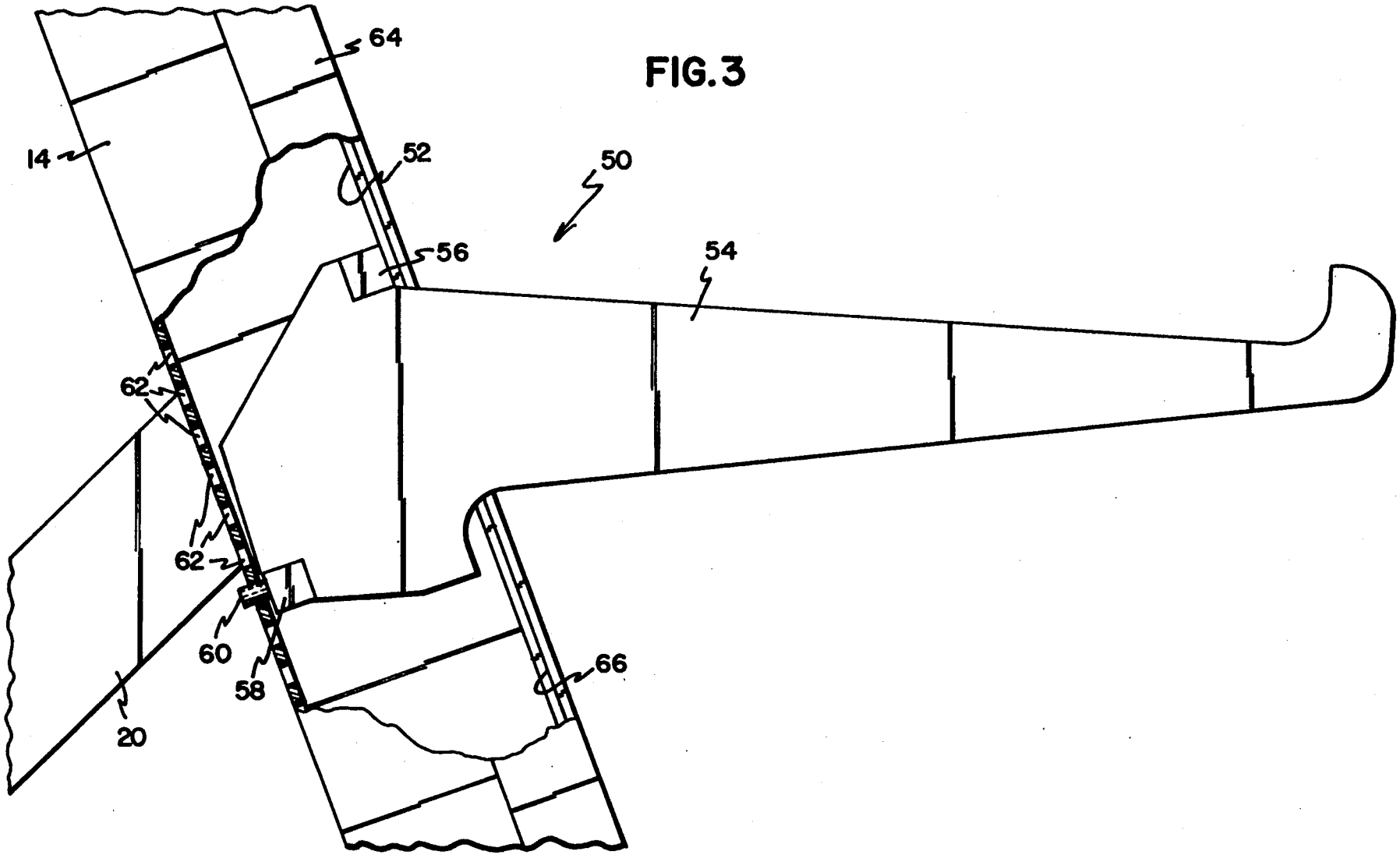
FIG. 3 is enlarged side view of one of the uprights showing further details of the adjustable safety/range limiting bars therein.

Referring now to FIG. 3 in conjunction with FIGS. 1 and 2, the bench 10 further includes a safety/range limiting bar 50 within each upright 14 which can be adjustably positioned between the upper end lower extreme positions shown in phantom lines in FIG. 2. Slots 52 of inverted T-shaped configuration are provided in the front sides of the uprights 14. Each bar 50 includes a projecting arm 54 which extends outwardly through the slots 52. The inside end of each arm 54 includes a top front transverse stop 56 and a rear bottom transverse stop 58, which are dimensioned and arranged for wedging engagement within the upright 14. The top front stop 54 extends across the stem portion of the T-shaped slot 52. A projecting pin 60 is provided on the rear bottom stop 58 for receipt within any selected one of a column of holes 62 in the back side of the upright 14 in order to provide incremental location and positioning of the bar 50 as desired. It will be understood, however, that pins 60 and holes 62 serve primarily a locating function, and only incidentally a supporting function. Bars 50 are secured against slippage by the frictional wedging action between stops 56 and 58 and the inside walls of the uprights 14, while pins 60 and holes 62 provide adjustment in fine increments such as about one-half inch.

Wear guards 14 are preferably provided on the uprights 14 of bench 10. The wear guards 64, which extend downwardly from the top ends of the uprights 14, include slots 66 which overlie the stem portions of slots 52 but cover the lower end portions thereof through which the bars 50 are inserted into the uprights 14 during assembly for positioning as desired. In the preferred embodiment, the wear guards 64 are of channel configuration formed from UHMW (Ultra-High Molecular Weight) polyethylene extending about the entire front side and substantial portions of the inner and outer sides of the uprights 14 in order to reduce noise when the bar is replaced or "racked" back onto the pins 40 or 42. Wear guards 64 also increase durability and reduce overall maintenance cost.

From the foregoing, it will thus be apparent that the present invention comprises an improved bench press having several advantages over the prior art. One significant advantage involves the use of adjustable safety/range limiting bars which can readily be adjusted as desired over a wide range. Another important feature is the bench height which enhances both stability and safety for the athlete using the bench press herein. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. A safety/catch bar assembly for use with an exercise device, which comprises:

an upright having spaced apart inclined front and back walls, the front wall having an elongate slot therein;

a bar having an inner end and an opposite upwardly curved outer end, the inner end being adapted to extend through the slot in the front wall of said upright;

a pair of spaced apart front and back stops secured to the inner end of said bar for wedging engagement between the front and back walls of said upright;

the slot in the front wall of said upright including an enlarged portion dimensioned for passage of said stops therethrough; and a locator pin secured to the inner end of said bar for selective registration with a column off spaced apart holes in the back wall of said upright.

2. A bench press, comprising:

a pair of laterally spaced apart uprights, each of said uprights having opposite top and bottom ends and opposite front and back walls;

both of said uprights being inclined at a predetermined acute angle off vertical;

support frame means including a cross member connected between the bottom ends of said uprights;

a substantially flat bench positioned between said uprights and supported on a portion of said support frame means;

a safety/range limiting bar mounted for adjustable positioning along each of said uprights, each safety bar including an inner and disposed within the respective upright and extending through a slot in the front wall thereof to an outer end;

stop means secured to the inner end off each safety bar for wedging engagement between the front end back walls of the respective upright upon downward pivotal movement of the outer end of the safety bar; and locator pin means secured to the inner end of each safety bar for selective registration with a column of spaced apart holes in the back wall of the respective upright.

3. The bench press off claim 2, wherein said uprights are angled at about 18 to 25 degrees in the same direction off vertical.

4. The bench press of claim 2, wherein both of said uprights are angled at about 20 degrees in the same direction off vertical.

5. The bench press of claim 2, wherein said bench is elevated above an underlying support surface a predetermined distance so that the plane defined by the head, shoulders and back of an athlete lying thereon with his/her feet on the underlying support surface extends substantially beneath his/her knees.

6. The bench press according to claim 5, wherein said bench is elevated at about 10 to 14 inches above the underlying support surface.

7. The bench press according to claim 5, wherein said bench is elevated at about 12 inches above the underlying support surface.

8. The bench press of claim 2, wherein said bench includes an upholstered cover enclosing a pad.

9. The bench press of claim 2, further including:

at least one support peg mounted near the top end of each upright.

10. The bench press of claim 2, further including:

wear guards secured to the front walls of sad uprights and extending substantially between the top and bottom ends thereof, said wear guards being formed from ultra high molecular weight polyethylene.

11. A bench press, comprising:

a pair of laterally spaced apart uprights, each upright having opposite top and bottom ends and opposite front and back walls;

both of said uprights being inclined inn the same direction at a common predetermined acute angle off vertical;

support frame means including a cross member connected between the bottom ends of said uprights;

an elevated, substantially flat bench positioned between said uprights and supported on a portion of said support frame means, said bench being elevated at a predetermined height so that a plane defined by the head, shoulders and back of an athlete lying thereon with his/her feet on the ground extends substantially beneath the knees off the athlete;

pair of safety/range limiting bars, each associated with one of said uprights;

each bar having an inner end and extending through a slot in the front wall of the respective upright to an opposing, upwardly curved outer end;

stop means secured to the inner end of each bar for wedging engagement between the front and back walls of the respective upright in order to retain said bars in the desired position; and locator pin means secured to the inner end of each safety bar for selective registration with a column of spaced apart holes in the back wall of the respective upright.

* * * * *